US012760902B2

(12) United States Patent
Lin Hu

(10) Patent No.: US 12,760,902 B2
(45) Date of Patent: Oct. 13, 2026

(54) FIRE PIT

(71) Applicant: Thirtieth Sense Co., Ltd., New Taipei (TW)

(72) Inventor: Yang Lin Hu, New Taipei (TW)

(73) Assignee: Thirtieth Sense Co., Ltd., New Taipei (TW)

( * ) Notice: Subject to any disclaimer, the term of this patent is extended or adjusted under 35 U.S.C. 154(b) by 289 days.

(21) Appl. No.: 18/808,115

(22) Filed: Aug. 19, 2024

(65) Prior Publication Data

US 2026/0049720 A1 Feb. 19, 2026

(51) Int. Cl.
*F24B 1/192* (2006.01)
*F24B 3/00* (2006.01)

(52) U.S. Cl.
CPC ..... *F24B 3/00* (2013.01)

(58) Field of Classification Search
CPC .. F24B 3/00; F24B 1/192; F24B 15/36; F24C 15/36; F24C 1/16; A24F 19/04
See application file for complete search history.

(56) References Cited

U.S. PATENT DOCUMENTS 4,624,238 A * 11/1986 Hait ..... F24B 1/205 126/305
5,404,864 A * 4/1995 Kent, Jr. ..... A47J 37/0763 126/25 B
5,992,407 A * 11/1999 Tsai ..... F24C 3/14 248/163.1
D984,610 S * 4/2023 Shen ..... D23/332
2017/0023253 A1* 1/2017 Smith ..... F24B 1/192
2019/0145625 A1* 5/2019 Satterley ..... F24C 1/16 126/9 R

FOREIGN PATENT DOCUMENTS

CN 2713332 Y * 7/2005
KR 2015064341 A * 6/2015
KR 20220002490 U * 10/2022 ..... F24C 1/16

* cited by examiner

*Primary Examiner* — Kristen C Hayes

(57) ABSTRACT

A fire pit comprises a body, a support plate mounted at the upper opening of the body, the support plate having multiple tracks, multiple blades pivotally arranged on the support plate, and a top plate positioned atop the blades. Rotation of the top plate causes the blades to rotate relative to the support plate to form either an open or closed state. This design reduces the risk of users losing the lid, and when the blades are in the closed state, they can serve as a grill or tabletop, increasing user convenience and saving on material costs.

6 Claims, 5 Drawing Sheets

FIRE PIT

FIELD OF INVENTION

The present disclosure relates to a fire pit, in particular a fire pit with a rotatable cover structure.

BACKGROUND OF THE INVENTION

Camping is a popular activity for many people. During the night or in cold weather, fire pits are often used as outdoor heating devices. Traditional fire pits require a lid to be placed on them when not in use to prevent rainwater or dust from entering. Additionally, the closed lid can serve as a convenient surface for placing objects.

However, the lid and the fire pit are two separate components. It is common for people to forget to retrieve the lid after casually placing it somewhere, leading to the need for a replacement lid for future use. This increases the cost to the consumer.

SUMMARY OF THE INVENTION

Based on the above shortcomings, the purpose of the present disclosure is to provide a fire pit, specifically a fire pit with a rotatable cover structure.

In accordance with its purpose, the present disclosure provides a fire pit comprising a body and a rotatable cover structure. The body features a through upper opening and a lower opening, characterized in that the rotatable cover structure includes: a support plate mounted at the upper opening, multiple blades pivotally arranged on the support plate, and a top plate positioned atop these blades. The top plate can drive the blades to rotate relative to the support plate.

Wherein the top plate has multiple grooves, while the support plate has multiple tracks.

Wherein each blade has an upper tenon on its upper surface and a lower tenon on its lower surface. The upper tenon of each blade fits into one of the grooves, while the lower tenon fits into one of the tracks.

Wherein the top plate has multiple grooves and the support plate has multiple positioning elements on its upper surface that correspondingly fit into the grooves.

Wherein each blade has a swing arm, which is fixed to the top plate via a pivot shaft. When the top plate rotates, it drives the blade to rotate with the pivot shaft as the axis.

Wherein a smoke outlet is provided at the center of the support plate. The top plate can drive the blades to rotate relative to the support plate to open or close the smoke outlet.

DETAILED DESCRIPTION OF THE PREFERRED EMBODIMENTS

Figure 1:
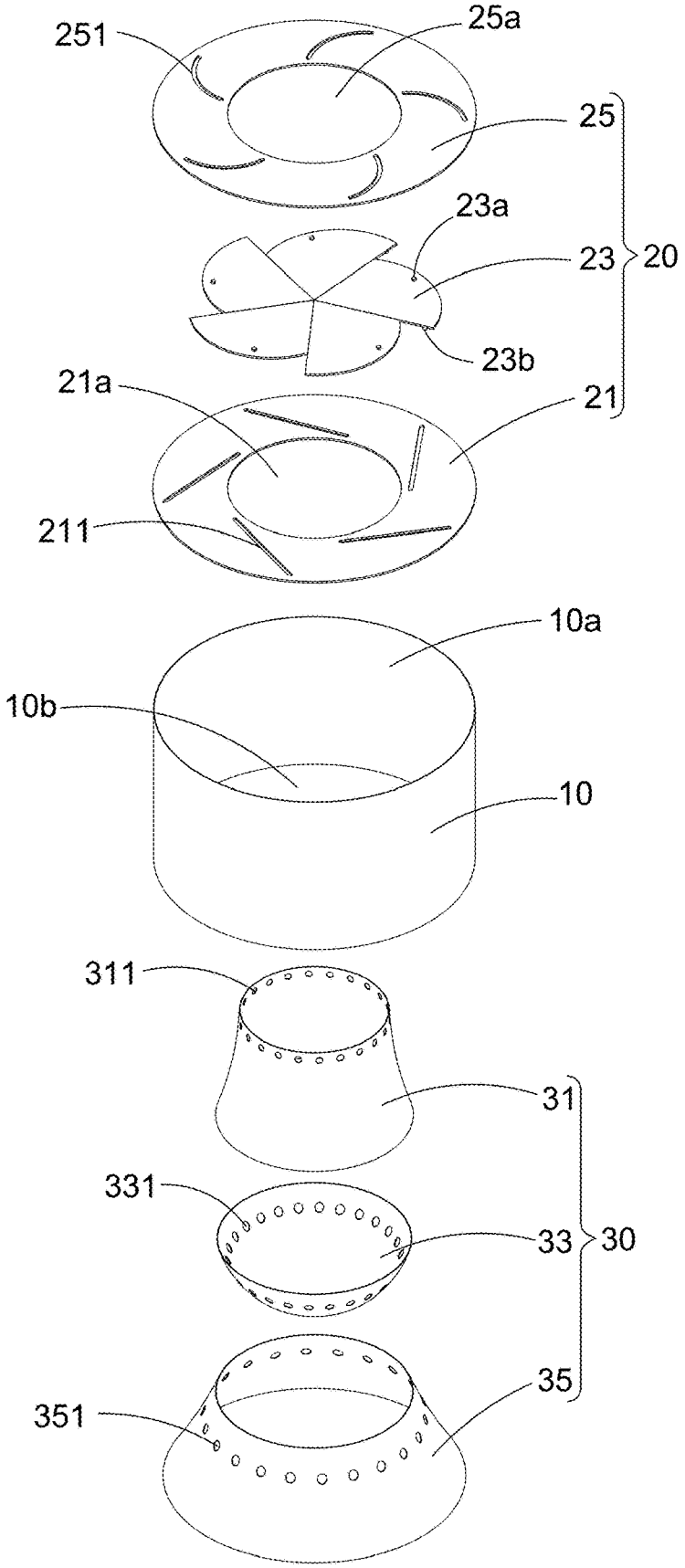
FIG. 1 is an exploded view of the components of the first embodiment.

To clearly describe the specific implementation methods, structures, and effects achieved by the present invention, the following embodiments are provided and described with reference to the accompanying drawings:

Reference is made to FIG. 1, which illustrates a fire pit comprising a body 10 and a rotatable cover structure 20. The body 10 features a through upper opening 10*a* and a lower opening 10*b*, with an inner furnace structure 30 housed within the body 10.

Figure 2:
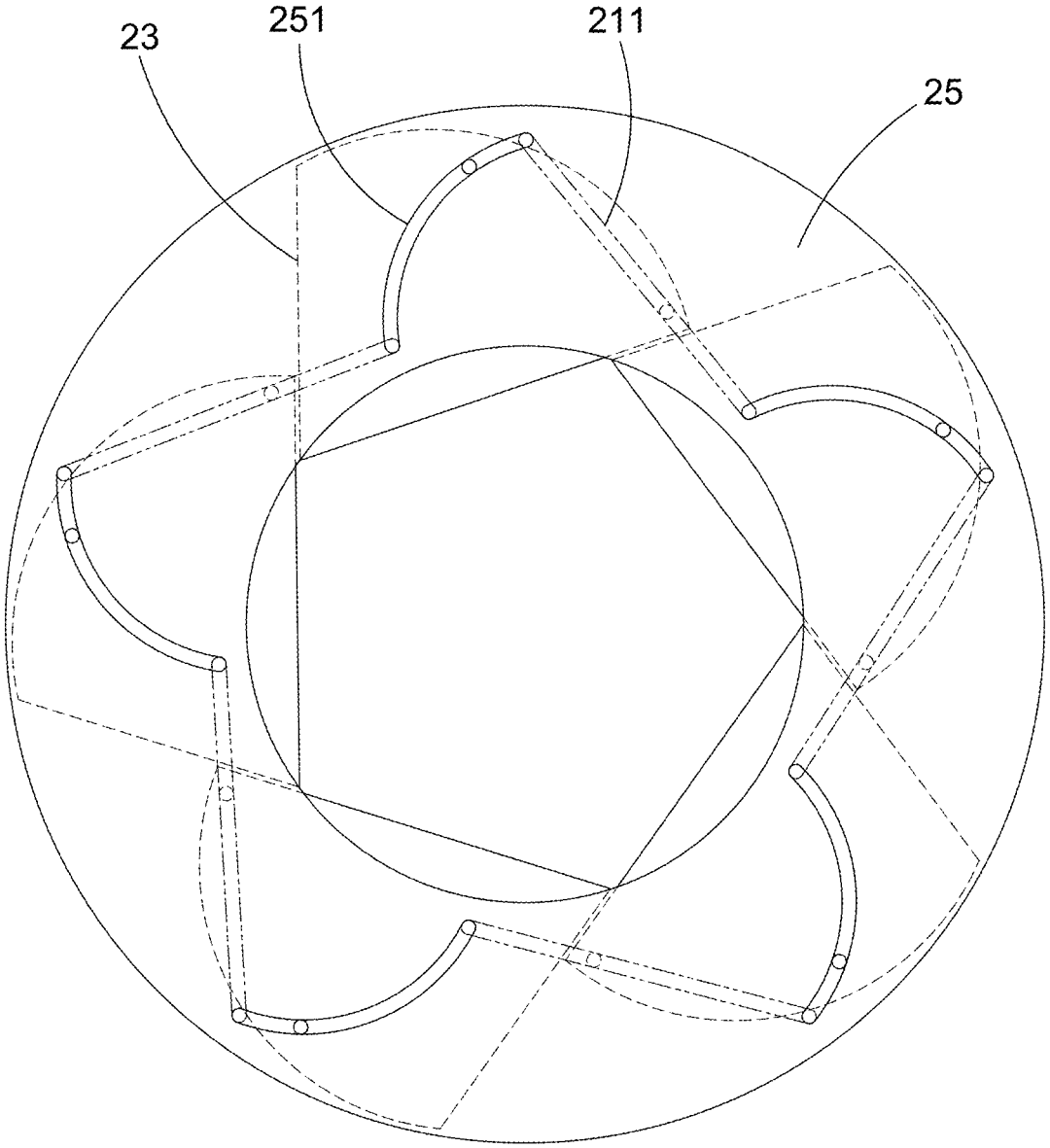
FIG. 2 is a schematic diagram in the open state of the first embodiment.
Figure 3:
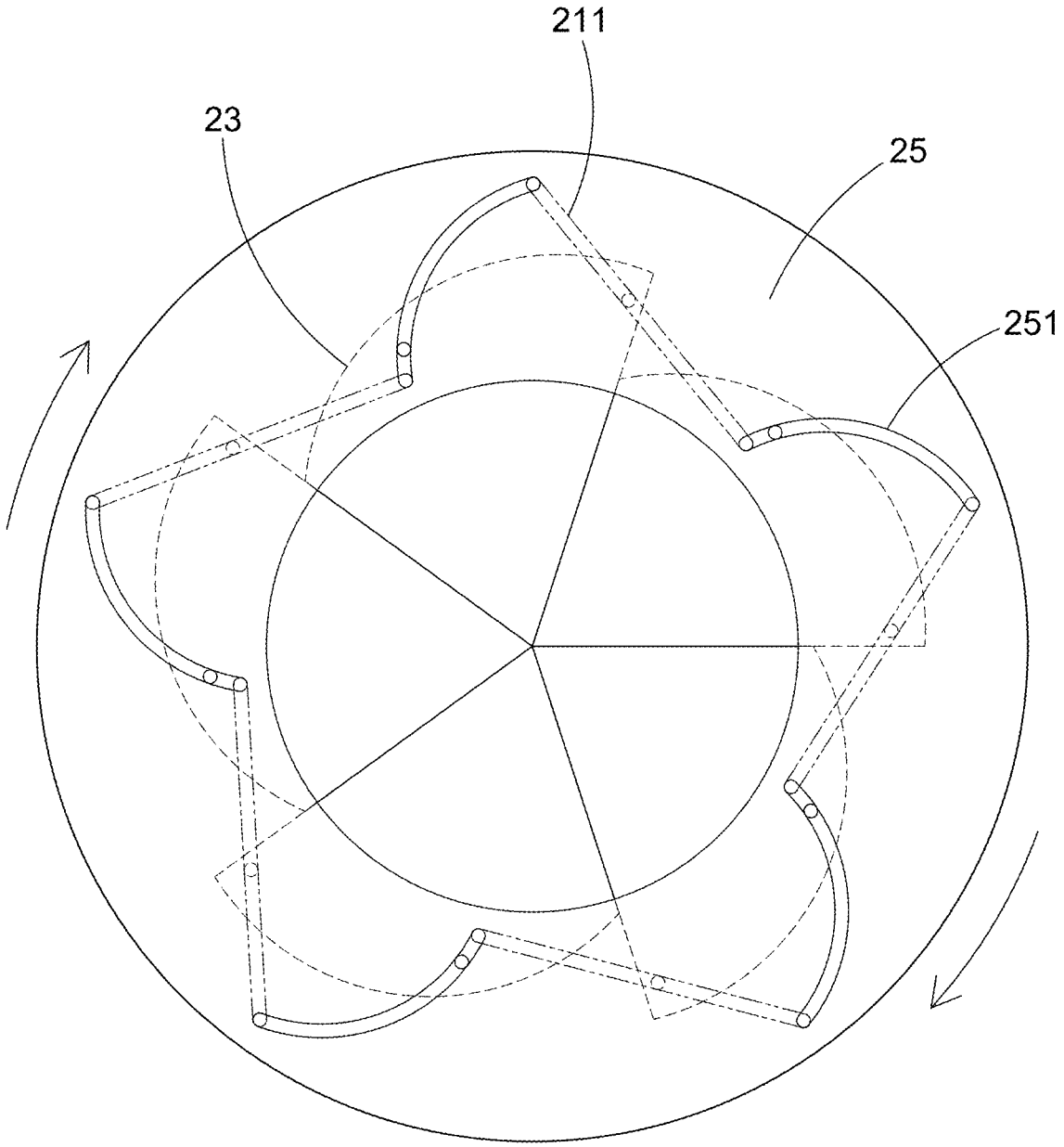
FIG. 3 is a schematic diagram in the closed state of the first embodiment.

Further reference is made to FIGS. 2 and 3. In a first embodiment, the rotatable cover structure 20 comprises a support plate 21, multiple blades 23, and a top plate 25. The support plate 21 is mounted at the upper opening 10*a* of the body 10, with a smoke outlet 21*a* at its center. The support plate 21 includes multiple strip-shaped tracks 211, each of which is angled and spaced apart. The top plate 25 includes an opening 25*a* that aligns with the smoke outlet 21*a*.

Each blade 23 has a lower tenon 23*b* on its lower surface and an upper tenon 23*a* on its upper surface. The lower tenon 23*b* of each blade 23 fits into one of the tracks 211, while the upper tenon 23*a* fits into one of the grooves 251 on the top plate 25. This configuration allows the top plate 25 to drive the blades 23 to rotate relative to the support plate 21, achieving either an open state (as shown in FIG. 2) or a closed state (as shown in FIG. 3). To use the fire pit, the user rotates the top plate 25 counterclockwise, causing the blades 23 to rotate counterclockwise as well, exposing the smoke outlet 21*a* for placing fuel into the inner furnace structure 30 for ignition and combustion. After use, the user rotates the top plate 25 clockwise, causing the blades 23 to rotate clockwise, closing the smoke outlet 21*a* to prevent rainwater or dust from entering the fire pit. When closed, the blades 23 seal the smoke outlet 21*a* and can also serve as a grill or general tabletop.

Figure 4:
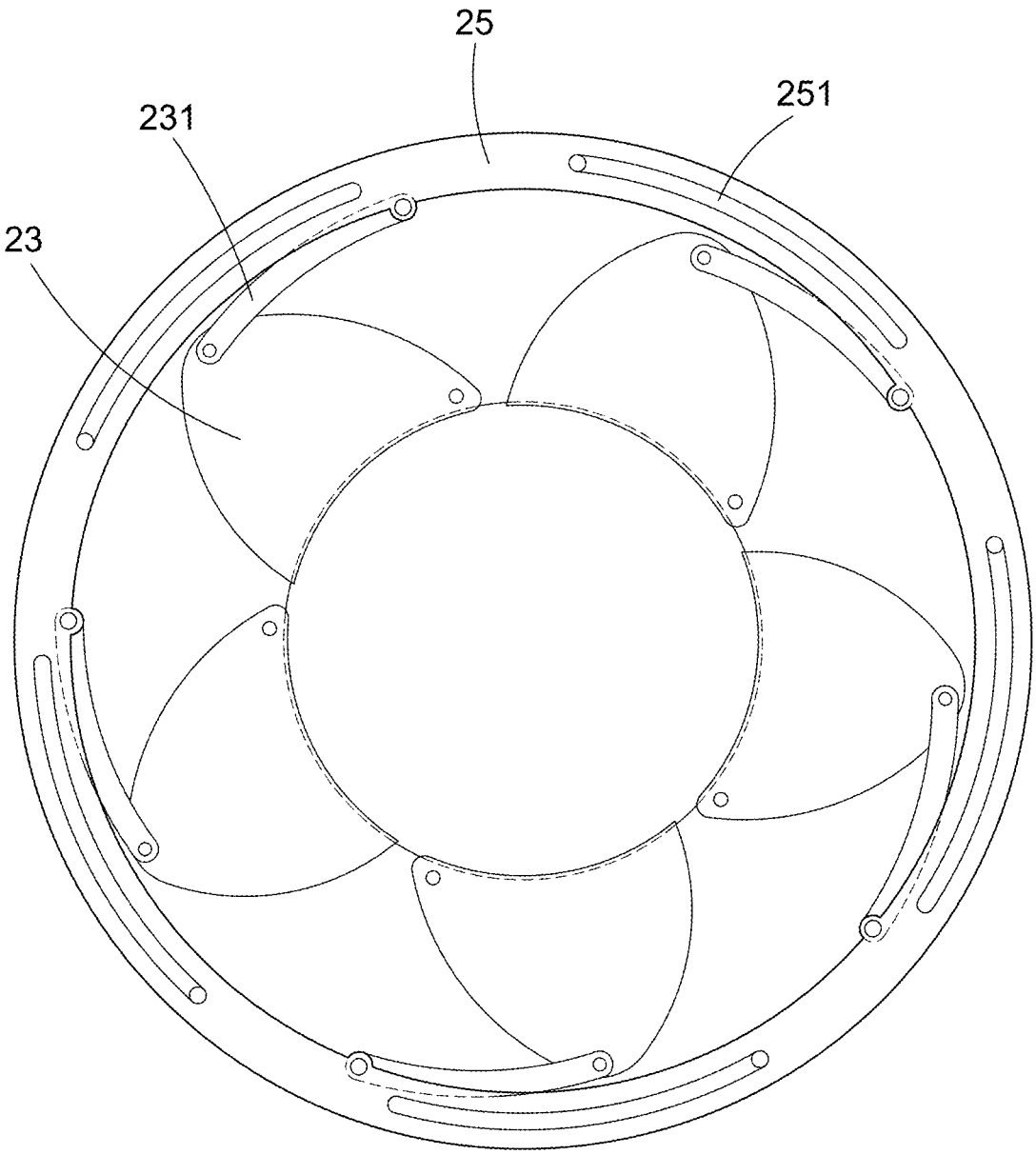
FIG. 4 is a schematic diagram in the open state of the second embodiment.
Figure 5:
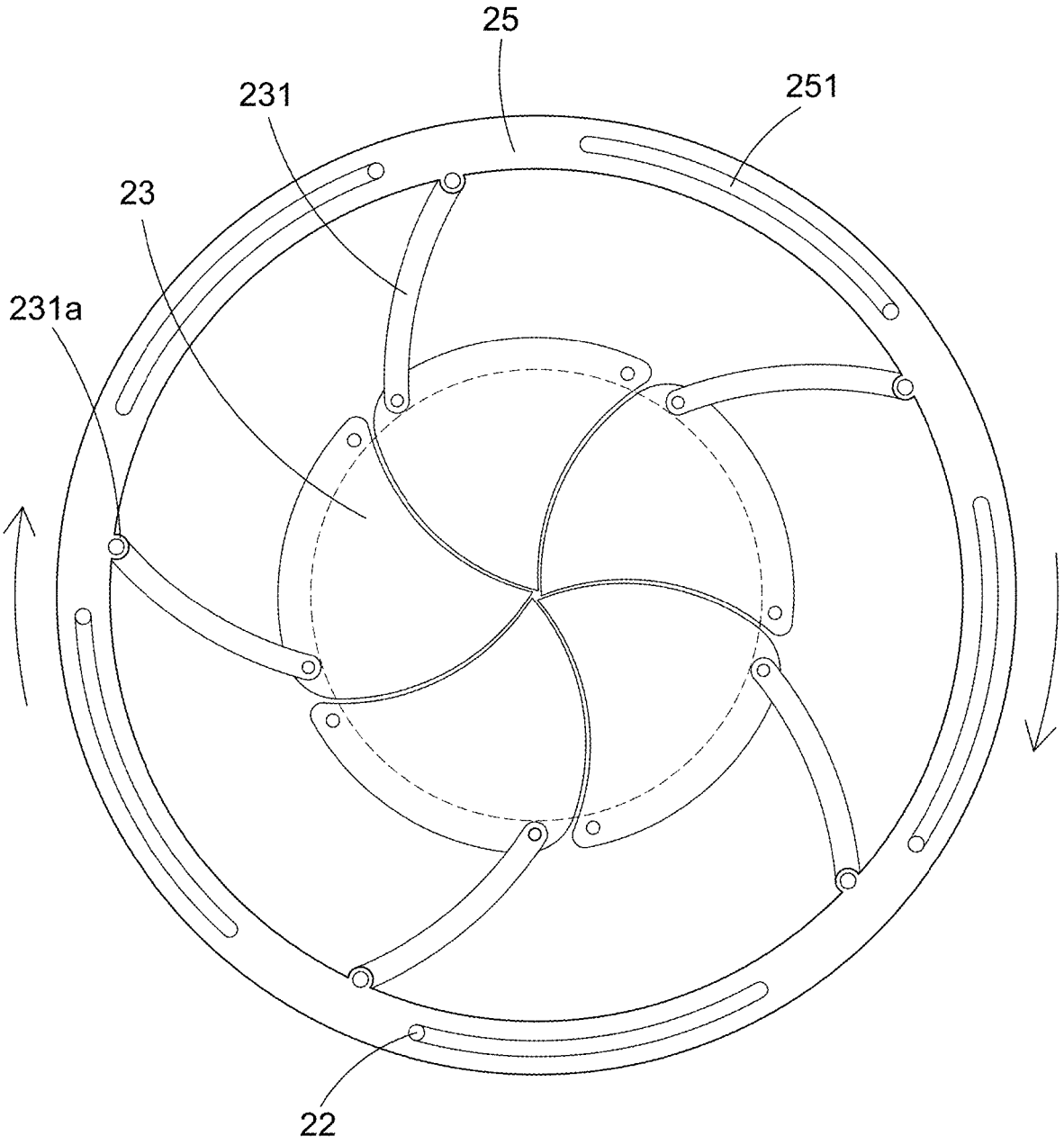
FIG. 5 is a schematic diagram in the closed state of the second embodiment.

Reference is made to FIGS. 4 and 5. In a second embodiment, the top plate 25 comprises multiple grooves 251, and the support plate 21 comprises multiple positioning elements 22 on its upper surface. These positioning elements 22 correspondingly fit into the grooves 251, allowing the top plate 25 and the support plate 21 to be fixed to each other while still being able to rotate relative to each other.

Each blade 23 also includes a swing arm 231. One end of the swing arm 231 is attached to the blade 23, and the other end is attached to the top plate 25 via a pivot shaft 231*a*. When the top plate 25 rotates, it drives the swing arm 231 to rotate with the pivot shaft 231*a* as the axis, forming either an open state (as shown in FIG. 4) or a closed state (as shown in FIG. 5). In the second embodiment, a fixing structure is also provided in the groove 251 of the top plate 25, which can secure the top plate 25 to the support plate 21.

For further description, the inner furnace structure 30 includes an inner combustion barrel 31 positioned above an ash collection bowl 33. Within the inner combustion barrel 31, there is a fuel support rack (not shown) designed for placing fuel such as dry firewood, twigs, leaves, or grass. The ash collection bowl 33 is used to hold the ash after combustion.

For further description, the inner combustion barrel 31 has an upper opening and a lower opening that are through from top to bottom, with the lower opening being larger than the upper opening. The ash collection bowl 33 is connected to the lower opening of the inner combustion barrel 31, while the upper opening is connected to the smoke outlet 21*a* of the support plate 21. The wall of the inner combustion barrel 31 features multiple air holes 311, distributed near the upper opening and arranged at intervals along the circumference. Similarly, the wall of the ash collection bowl 33 has multiple air holes 331, distributed near the upper opening and arranged at intervals along the circumference. These air holes allow external cold air to enter the inner furnace structure 30, helping to maintain the fire.

In this embodiment, a support furnace rack 35 is provided below the inner furnace structure 30. The wall of the support furnace rack 35 features multiple air holes 351. The support furnace rack 35 has an upper opening and a lower opening that are through from top to bottom, with the lower opening being larger than the upper opening. The contour of the upper opening is approximately equal to that of the ash collection bowl 33, allowing the ash collection bowl 33 to fit into the upper opening of the support furnace rack 35 and support the inner furnace structure 30. Additionally, the support furnace rack 35 can prevent the hot air from the inner furnace structure 30 from directly contacting the ground, thus avoiding thermal damage to the ground.

In this embodiment, the external cold air enters through the air holes 351 of the support furnace rack 35 to maintain the fire in the inner furnace structure 30. At the same time, the air is directed downwardly through the air holes 331 of the ash collection bowl 33 to channel the hot air between the body 10 and the inner furnace structure 30. The air is then directed back into the inner combustion barrel 31 through the air holes 311 near the inner combustion barrel 31 to cause secondary combustion. The secondary combustion can allow the fire to burn more thoroughly and reduce the smoke produced by the combustion.

By rotating the top plate 25 to drive the blades 23 to rotate relative to the support plate 21, the present disclosure can achieve the open or closed state, preventing rainwater or dust from entering the fire pit interior and reducing the risk of users losing the lid. When the blades 23 are in the closed state, they can also be used as a grill or tabletop, increasing user convenience and saving on material costs.

What is claimed is:

1. A fire pit, comprising a body and a rotatable cover structure, the body featuring a through upper opening and a lower opening, characterized in that the rotatable cover structure includes:

a support plate, mounted at the upper opening;

multiple blades, pivotally arranged on the support plate; and a top plate, positioned atop the blades, and the top plate drives the blades to rotate relative to the support plate.

2. The fire pit as claimed in claim 1, wherein the top plate has multiple grooves, and the support plate has multiple tracks.

3. The fire pit as claimed in claim 2, wherein each blade has an upper tenon on its upper surface and a lower tenon on its lower surface, the upper tenon fitting into one of the grooves and the lower tenon fitting into one of the tracks.

4. The fire pit as claimed in claim 1, wherein the top plate has multiple grooves, and the support plate has multiple positioning elements on its upper surface that correspondingly fit into the grooves.

5. The fire pit as claimed in claim 4, wherein each blade has a swing arm, which is fixed to the top plate via a pivot shaft, when the top plate rotates, it drives the blade to rotate with the pivot shaft as the axis.

6. The fire pit as claimed in claim 1, wherein a smoke outlet is provided at the center of the support plate, and the top plate drives the blades to rotate relative to the support plate to open or close the smoke outlet.

* * * * *